United States Patent [19]

Thacker

[11] Patent Number: 4,575,073

[45] Date of Patent: Mar. 11, 1986

[54] CHILD'S SWING SEAT

[75] Inventor: Robert W. Thacker, West Point, Miss.

[73] Assignee: Blazon-Flexible Flyer, Inc., West Point, Miss.

[21] Appl. No.: 731,149

[22] Filed: May 6, 1985

[51] Int. Cl.[4] ..... A63G 9/00

[52] U.S. Cl. ..... 272/85; 297/273; 297/DIG. 2

[58] Field of Search ..... 272/85, 86, 87, 88, 272/89, 90, 91, 92; 297/4, 5, 6, 273, DIG. 2, 42, 45; D21/246; 182/7; 4/DIG. 8; 264/46.7

[56] References Cited

U.S. PATENT DOCUMENTS

| | | | |
|---|---|---|---|
| 324,513 | 8/1885 | Albrecht | 272/85 UX |
| 1,975,262 | 10/1934 | Evans et al. | 155/58 |
| 3,260,522 | 7/1966 | White et al. | 272/85 |
| 3,261,607 | 7/1966 | Horowitz et al. | 272/85 |
| 3,352,555 | 11/1967 | Phillips | 272/85 |
| 3,462,195 | 8/1969 | Allen | 272/85 |
| 3,486,751 | 12/1969 | Hatfield et al. | 272/85 |
| 3,712,614 | 1/1973 | Sherman et al. | 272/85 |
| 3,897,056 | 7/1975 | Hock et al. | 272/85 |
| 4,478,410 | 10/1984 | Ziegler, Jr. | 272/85 |
| 4,524,966 | 6/1985 | Shannon et al. | 297/273 X |

FOREIGN PATENT DOCUMENTS

| | | | |
|---|---|---|---|
| 993342 | 7/1976 | Canada | 272/85 |
| 1457271 | 12/1976 | United Kingdom | 272/85 |

*Primary Examiner*—Robert A. Hafer
*Assistant Examiner*—Arnold W. Kramer
*Attorney, Agent, or Firm*—Renner, Kenner, Greive & Bobak Co.

[57] ABSTRACT

A child's swing seat having an elliptical strap-like perforated body of molded plastic material. A continuous strand of reinforcing cable is integrally molded in a peripheral flange on the body and has end loops projecting from the ends of the body forming hangers for attachment to suspending chains or strands for the seat. The end loops of the cable are covered with plastic during the molding operation.

10 Claims, 5 Drawing Figures

CHILD'S SWING SEAT

TECHNICAL FIELD

The invention relates generally to seats for children's swings, and more particularly to flexible, lightweight swing seats for safe use in playgrounds and gym sets.

BACKGROUND ART

Until comparatively recent years, seats for children's swings were of rigid heavy material such as wood or metal, but these were dangerous, especially to small children, because of the likelihood of unoccupied seats swinging into and injuring children playing or standing in the immediate vicinity.

As a result, certain lightweight seats have been developed utilizing flexible plastic material, which greatly reduce the possibility of injury to children when accidentally striking them. One such prior swing seat is disclosed in U.S. Pat. No. 3,897,056, comprising a flexible plastic seat of rectangular configuration having reinforcing spring steel straps extending along the side of the bottom surface yieldingly urging the seat toward a flat condition. Wire hangers are attached through the seat and to the ends of the straps for connection to suspending chains. This seat construction is complicated and comparatively expensive, especially due to the cost of the spring straps and the necessity of providing longitudinal series of keeper strips on the underside of the seat to retain the spring straps in position as they flex due to varying curvatures during use.

Another prior swing seat is disclosed in U.S. Pat. No. 4,478,410, comprising a flexible plastic seat also of rectangular configuration, in which laterally spaced longitudinal tubes are molded in the underside of the seat and metal chains are passed through the tubes, the outer ends of the chains being detachably connected to two suspending chains by metal clips. This construction requires the user to insert the seat chains through the tubes which is a somewhat difficult operation due to the curvature of the seat and the flexibility of the chains. Also, it is said to be safer than the construction of U.S. Pat. No. 3,897,056 because it eliminates the wire hangers of said patent and connects the ends of the seat chains directly to the suspending chains, thus providing flexible chains rather than rigid wire hangers should these parts accidentally strike a child.

This claim is somewhat questionable as the overlapping links of the seat chains and the edges of the connecting metal clips present relatively rough surfaces on contact.

Both of these prior constructions present corners and relatively sharp edges capable of injury due to their rectangular shapes.

DISCLOSURE OF THE INVENTION

The present invention comprises a flexible, lightweight swing seat of oval or elliptical configuration having flanged side edges for safety and a reinforcing cable molded in said side edges with projecting loops for attachment to the chains suspending the seat.

It is therefore an object of the present invention to provide a safe, lightweight and flexible swing seat of simple and inexpensive construction which does not require assembly by the user.

Another object is to provide an improved plastic swing seat having a molded-in reinforcing cable with projecting integral end loops for attachment to suspending chains by simple hooks.

A further object is to provide an improved plastic swing seat of elliptical configuration having flanged side edges and a continuous reinforcing cable molded in said side edges in offset relation to the plane of the seat.

These and other objects are accomplished by the improvements comprising the present invention, a preferred embodiment of which is disclosed herein by way of example, illustrating the best known mode of carrying out the invention. Various modifications and changes in details of construction are comprehended within the scope of the appended claims.

PREFERRED MODE FOR CARRYING OUT THE INVENTION

Figure 4:
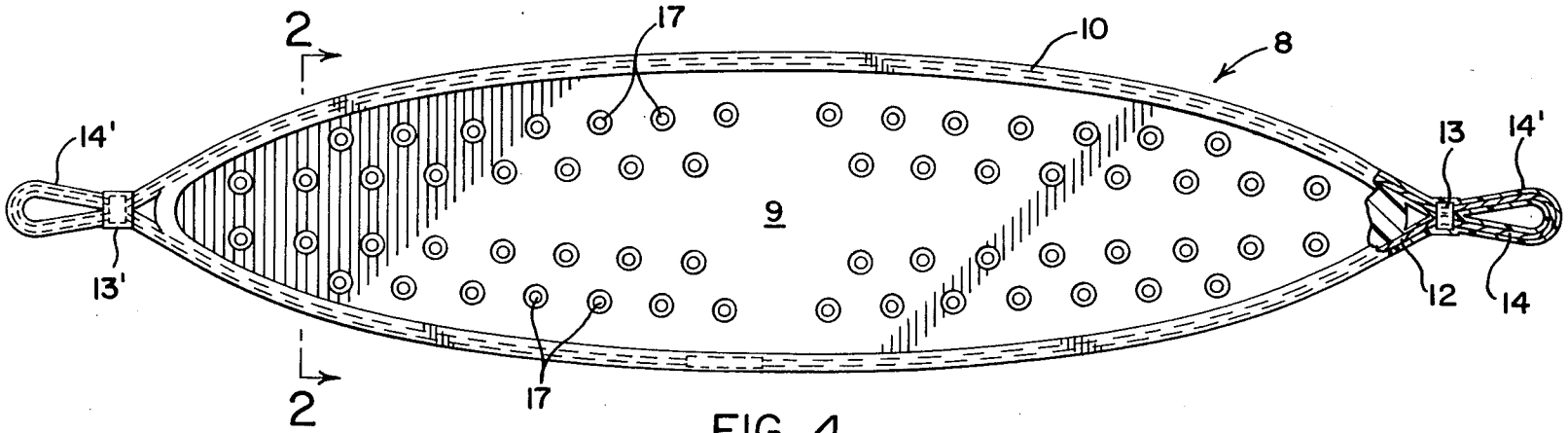
FIGS. 4 and 5 are top plan and side elevation developed views showing the improved swing seat in flat condition for the purpose of clearer illustration only.

The improved swing seat indicated generally at 8 has a strap-like body 9 which is generally an elongated ellipse as best shown in the developed view, FIG. 4. This shape eliminates sharp corners and is more comfortable than the rectangular seats of the prior patents. It is preferably molded plastic material, such as polyvinyl or polyethylene, which is flexible, somewhat resilient, lightweight and weather-resistant. A shallow raised rib 10 extends continuously around the outer periphery of the upper surface of the body, and a continuous flange 11 depends therefrom below the lower surface of the body, the flange becoming progressively deeper from the ends to the center of the seat. The bottom of the flange 11 is preferably rounded, and drain holes (not shown) may be provided at intervals extending from the top of the rib through the bottom of the flange.

Figure 1:
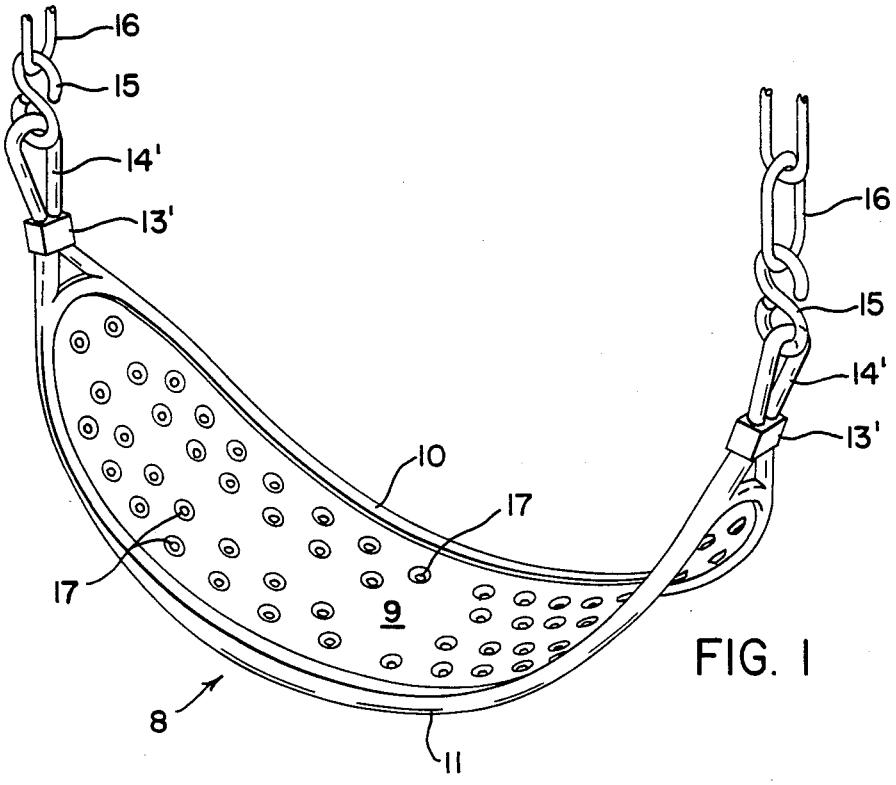
FIG. 1 is a perspective view of the improved swing seat in a curved condition as resulting from the weight of an occupant.
Figure 3:
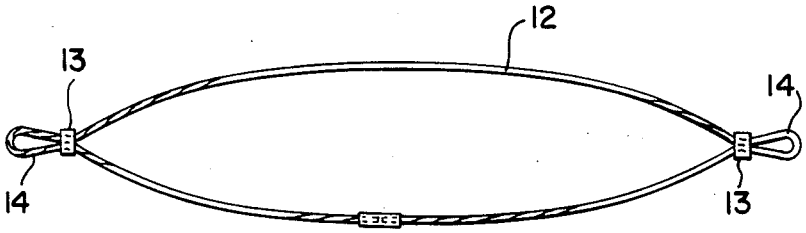
FIG. 3 is a plan view of the reinforcing cable before being molded in the seat.

A continuous strand of steel cable 12, preferably shaped as shown in FIG. 3 to conform to the elliptical configuration of the peripheral rib 10 and flange 11, is incorporated into the flange 11 during the molding process. The ends of the cable 12 are pinched together by clamps 13 prior to molding, forming loops 14 which project beyond the ends of the body of the seat, and in the molding operation a resilient, plastic covering is formed over the clamps 13 and the loops 14, as indicated at 13' and 14', respectively. Thus, there is no need for separate hanger brackets to connect the seat to the suspending chains 16; the connection can be effected by a simple S-link 15, as shown in FIG. 1.

Figure 5:
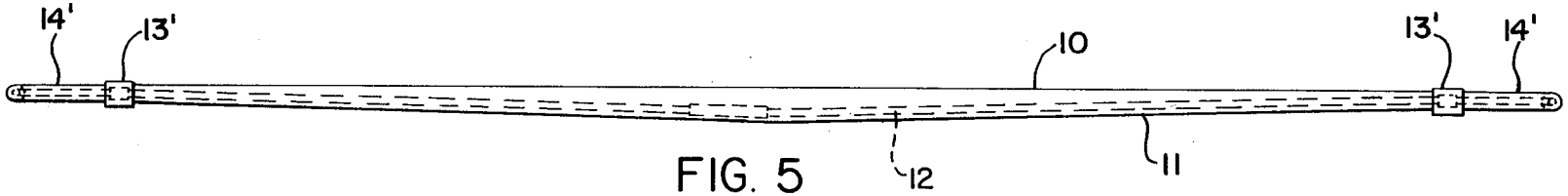

Although the seat 9 is shown flat in FIGS. 4 and 5, it is preferably molded in a gentle curve from the medial portions upwardly to the ends, so that easy access is provided for a child to become seated. The child's weight causes the flexible seat to bow to a position such as shown in FIG. 1, wherein it conforms to the child's body and provides a comfortable and confining support. When the load of the child is removed, the resiliency of the seat causes it to return to its original gently curved shape.

Figure 2:
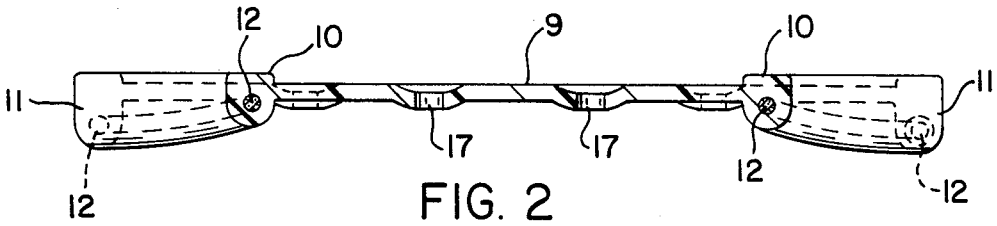
FIG. 2 is a transverse sectional view on line 2—2 of FIG. 4.

Referring to FIGS. 2 and 5, the curved side portions of the cable 12 when molded into the flanges 11 are not parallel with the plane of the seat, but generally follow the lower portions of the progressively deeper flanges at the medial portion of the seat, thereby providing greater reinforcement at the medial section where the occupant's weight is concentrated.

As shown, the body of the seat has series of perforations 17 for drainage and ventilation, and the perforations are preferably countersunk in the upper surface to present a roughened surface providing resistance to slippage by the occupant, along with the peripheral rib 10. Also, the upper surface may be textured to provide additional resistance.

The improved swing seat is lightweight, inexpensive, and flexible. It is especially safe because of its elliptical shape and to the fact that no metal is exposed and all surfaces are rounded and resilient. The molded-in reinforcing cable eliminates the possiblility of losing a separate part before assembly and the necessity for assembly by the user. Also, the projecting end loops provide integral hanger means.

I claim:

1. A swing seat comprinsing a generally elliptical straplike seat body of molded flexible and resilient plastic material, a strand of reinforcing cable integrally molded in the periphery of said seat body and having end loops projecting from the ends of said body to form hanger means for attachment to strands suspending the swing seat, and said seat body adapted when occupied to curve in conformance to the body of the applicant.

2. A swing seat as described in claim 1, wherein the upper surface of the seat body has a continuous raised peripheral rib.

3. A swing seat as described in claim 2, wherein a continuous peripheral flange depends from said rib.

4. A swing seat as described in claim 3, wherein said peripheral flange becomes progressively deeper from the ends to the medial section of said body.

5. A swing seat as described in claim 3, wherein the seat body has perforations countersunk in its upper surface.

6. A swing seat as described in claim 5, wherein the reinforcing cable is molded in the lower portions of said flange.

7. A swing seat as described in claim 5, wherein the end loops of the cable are completely covered with molded plastic material.

8. A swing seat as described in claim 7, wherein the seat body has perforations countersunk in its upper surface.

9. A swing seat as described in claim 1, wherein the seat body has perforations countersunk in its upper surface.

10. A swing seat as described in claim 1, wherein the end loops of the cable are completely covered with molded plastic material.

* * * * *